United States Patent [19]

Yadlowsky

[11] 4,274,213

[45] Jun. 23, 1981

[54] SCRAPER BLADE MOUNTING ASSEMBLY

[76] Inventor: Gene Yadlowsky, La Corey, Alberta, Canada

[21] Appl. No.: 78,501

[22] Filed: Sep. 24, 1979

[30] Foreign Application Priority Data

Oct. 2, 1978 [CA] Canada ..... 312454

[51] Int. Cl.[3] ..... E02F 3/76

[52] U.S. Cl. ..... 37/117.5; 37/41; 414/723; 414/912; 172/817

[58] Field of Search ..... 37/117.5, DIG. 3, DIG. 9–DIG. 12, 37/118 R, 41–42 R, 50; 414/697, 912, 706–707, 710–713, 722, 723, 724; 172/245, 247, 250–251, 253, 801, 803, 804

[56] References Cited

U.S. PATENT DOCUMENTS

| | | | |
|---|---|---|---|
| 2,684,163 | 7/1954 | Boulton | 37/117.5 X |
| 2,812,595 | 11/1957 | Drott | 37/DIG. 3 |
| 2,835,396 | 5/1958 | Pilch | 37/117.5 X |
| 3,001,654 | 9/1961 | Albert | 414/707 |
| 3,559,313 | 2/1971 | Firestone | 37/42 R |
| 3,776,318 | 12/1973 | Layton | 37/DIG. 3 |
| 4,076,080 | 2/1978 | Anderson | 172/247 X |

*Primary Examiner*—E. H. Eickholt

*Attorney, Agent, or Firm*—Balogh, Osann, Kramer, Dvorak, Genova & Traub

[57] ABSTRACT

A scraper or dozer blade mounting for earth and snow moving equipment of the type having a pair of forwardly projecting parallel boom arms and a pair of hydraulic cylinders to control positioning of a bucket or blade carried by the boom arm. The mounting consists of a cross-member adapted to be secured to the forward ends of the boom arms, and a scraper blade centrally pivoted to the cross-member. Articulated link arms extend from each hydraulic cylinder and are pivotally secured to the blade on opposite sides of the central pivot, and means for actuating the hydraulic cylinders in reverse orders thereby enabling control of the inclination of the blade with respect to the path of travel of the machine. Such a mounting assembly enables known earth and snow moving equipment to be converted to highly maneuverable earth and snow plowing equipment.

1 Claim, 5 Drawing Figures

SCRAPER BLADE MOUNTING ASSEMBLY

The present invention relates to earth and snow moving equipment and particularly relates to a mounting arrangement for an articulated dozer or scraper blade, enabling lifting and tilting of the blade, and also relates to conversion components enabling existing machinery to be converted from a loading bucket arrangement to an articulated scraper blade assembly in economical fashion to enable existing machinery to perform multiple tasks.

DISCUSSION OF PRIOR ART

Machinery having front mounted loader buckets are well known, and one such type of machine is disclosed in Canadian Pat. No. 826,033, issued Oct. 28, 1969, to J. I. Case Company. Such a machine is successful in its function of providing a scooping and lifting bucket to load earth and snow in trucks or to carry the load to a suitable location for dumping. However, it is not possible to utilize such known bucket structures which are tiltable only along a transverse horizontal axis as side-delivering scrapers (which are tiltable about vertical axes) and these known machines, while being well adapted to perform their primary function are not well adapted to work in areas where snow or earth is to be plowed, as opposed to the load being lifted and carried and then dumped.

Large earth moving machines such as the well-known Caterpillar graders can, of course, be used to plow earth or snow but this machinery is of such a large scale that it is not possible to use such equipment to move in or around constricted areas during snow removing operations such as in and around cars parked in a parking lot which is to be cleared of snow.

OBJECTS OF THE PRESENT INVENTION

The present invention provides a dozer blade mounting arrangement for existing bucket loader machinery which will enable these machines to be converted into efficient snow plowing and moving equipment and at a minimum cost and without requiring the purchase of completely new machinery.

By utilizing smaller type earth moving equipment such as rubber-tired front end loaders and back-hoe machines, it is possible to reduce the hourly cost of operation, and the applicant has found that by utilizing the present mounting arrangement on smaller type load moving equipment that it is possible to preduce the cost per hour of operation by fifteen–thirty dollars over the conventional graders or crawler type machines.

The objects are achieved by the present invention which specifically provides a scraper or dozer blade mounting for earth or snow moving machines of the type having a pair of forwardly projecting parallel boom arms and a pair of first hydraulic cylinder-pistons to control the positioning of the boom arms and the elevation of the bucket, and one of a pair of second hydraulic cylinder-pistons carried by each boom arm to control the inclination of the bucket with respect to a horizontal axis, the piston of each second hydraulic cylinder-piston being pivotally secured to its respective boom arm and the cylinder of each second cylinder-piston being pivotally secured to an upstanding link arm, the lower end of each link arm being pivotally secured to its respective boom arm and the upper end of each link arm being pivotally secured to a link rod which extends forwardly for pivotal securement to the bucket, and control valve means for effecting movement of the second cylinder-pistons, and comprising a cross-member pivotally secured to the forward ends of the boom arms, and a scraper blade centrally pivoted to the cross-member, and a stabilizing link extending between the cross-member and the boom arms for maintaining the cross-member in set angular relationship with respect to the boom arms, and a pair of articulated link members pivotally secured between the scraper blade and the upper ends of each of said upstanding link arms, connections between the second cylinder-pistons and the control valve means being reversed enabling angling of the blade with respect to a vertical axis.

A further object is to provide conversion apparatus for loader bucket earth moving machinery of the type having a pair of forwardly projecting parallel boom arms and a pair of first hydraulic cylinder-pistons to control the positioning of the boom arms and the elevation of the bucket, and one of a pair of second hydraulic cylinder-pistons carried by each boom arm to control the inclination of the bucket with respect to a horizontal axis, the piston of each second hydraulic cylinder-piston being pivotally secured to its respective boom arms and the cylinder of each second cylinder-piston being pivotally secured to an upstanding link arm, the lower end of each link arm being pivotally secured to its respective boom arm and the upper end of each link arm being pivotally secured to a link rod which extends forwardly for pivotal securement to the bucket, and control valve means for effecting movement of the said second cylinder-pistons, and comprising a cross-member for pivotal securement to the forward ends of the boom arms, and a scraper blade adapted for centrally pivoted securement to the cross-member, and a stabilizing link for extending between the cross-member and the boom arms for maintaining the cross-member in set angular relationship with respect to the boom arms, and a pair of articulated link members for pivotal securement between the scraper blade and the upper ends of each of said upstanding link arms, connections between the second cylinder-pistons and the control valve means being reversed enabling angling of the blade with respect to a vertical axis.

BRIEF DESCRIPTION OF ACCOMPANYING DRAWINGS

These and further objects and advantages of the present invention will become more apparent from the following description when taken in conjunction with the accompanying drawings, and wherein.

DETAILED DESCRIPTION OF ACCOMPANYING DRAWINGS

Figure 1:
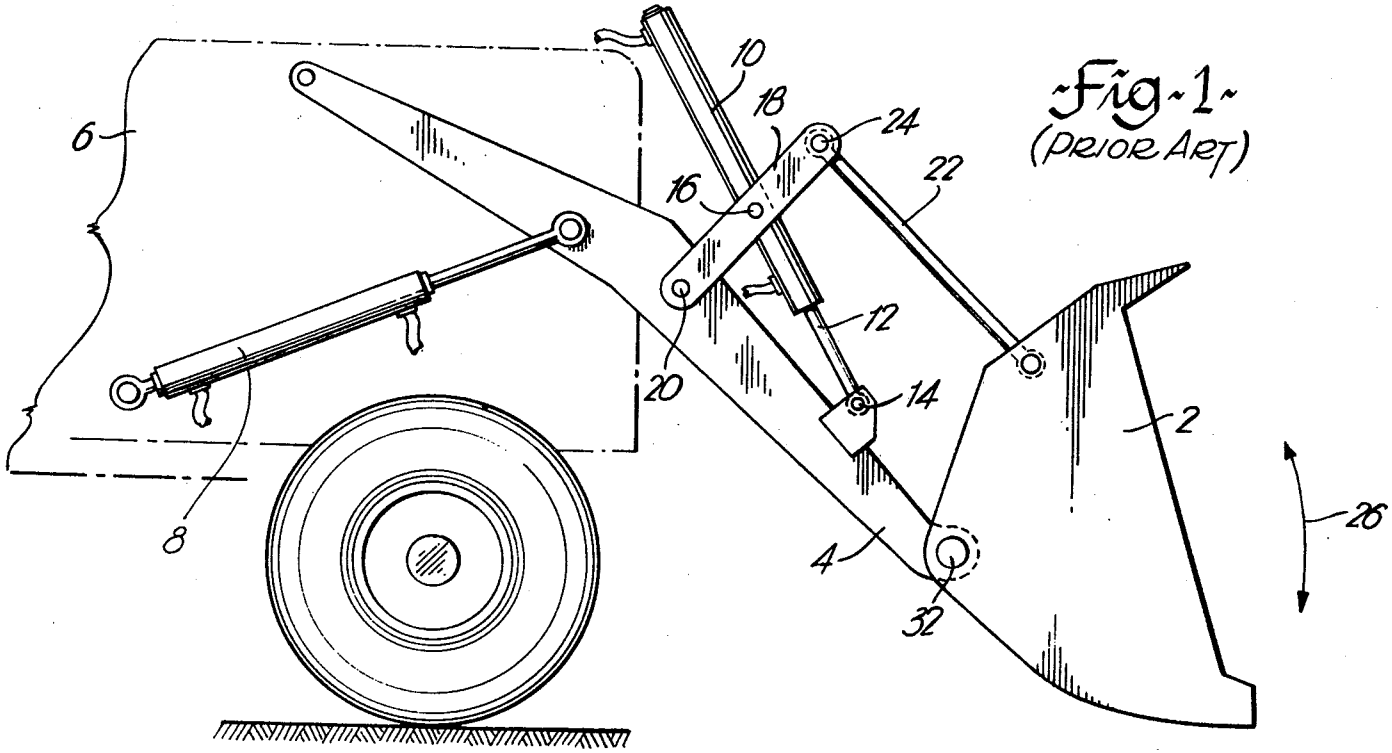
Fig. 1 (Prior Art)
FIG. 1 illustrates in side view a conventional front end loader bucket arrangement.

FIG. 1 illustrates a known loading bucket mounting arrangement wherein the bucket 2 is mounted for scooping, lifting, and dumping. The bucket 2 is pivotally secured to two forwardly extending boom arms 4 which are pivotally attached at their rearward ends to the framing of a vehicle generally designed by numeral 6. FIG. 1 is a side view and only one boom arm 4 is shown, but it will be appreciated that a boom arm is provided on each side of the vehicle and that the boom arm extends parallel and forwardly for respective pivotal securement to the bucket 2.

The boom arms and the bucket 2 carried thereby are raised and lowered by suitable means such as hydraulic cylinders 8 which are operated to cause lifting and lowering of the outer ends of the boom arms. The inclination of the bucket 2 about a horizontal axis is controlled by hydraulic cylinders 10. The piston rods 12 of the cylinders 10 are pivotally secured as at 14 to the boom arms 4 and the cylinder casing 10 is pivotally secured at 16 to link members 18. Link 18 at its lower end is pivotally secured to the boom arm 4 at 20, and at its upper end is pivotally secured to a further link member 22 by suitable pivotal means such as bolt or pivot 24. Actuation of the cylinder-piston arrangement 10, 12 will of course result in a tilting of the bucket around a horizontal axis as illustrated by the double-ended arrow 26 in FIG. 1. This arrangement provides for a very simple and efficient bucket maneuvering device, but with such an installation the bucket is secured against any inclination in a direction with respect to the longitudinal path of movement of the machine. This prevents the bucket from being used as a plow to displace material to the side of the path of movement of the vehicle.

A modification of this mounting assembly is shown in FIGS. 2 through 5 and these component parts enable replacement of the bucket 2 with a scraper or dozer blade 28 whereby the blade may be positioned in a straight ahead position, or inclined to the left or right depending upon the requirements of the operator of the vehicle.

Figure 3:
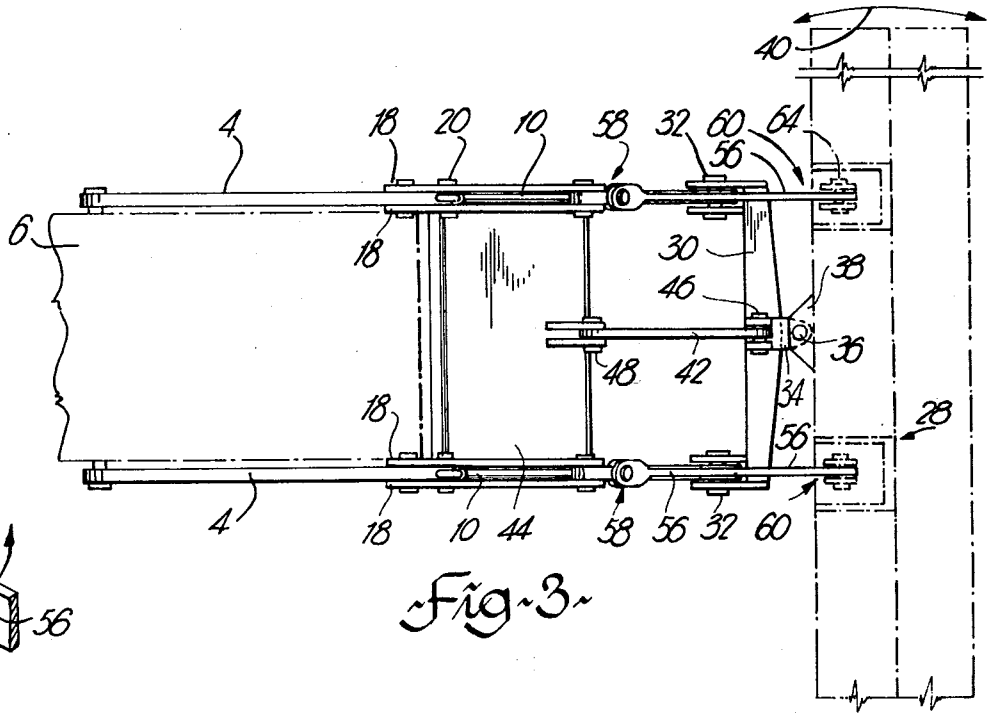
FIG. 3 illustrates the assembly as shown in FIG. 2 in top view.

The boom arms 4 remain unchanged, but the outer forwardly projecting ends of the boom arms are provided with a cross-member 30 which is pivotally secured to the forward ends of the boom arms by pivots 32 as shown. This cross member 30 is provided with a forwardly projecting central bracket 34 (see FIG. 3) which carries a pivot pin 36 and which is adapted for engagement with a bracket 38 provided on the rearward side of a dozer or scraper blade 28. With this single point of pivotal securement, it will be quite apparent from FIG. 3 that the blade 28 is capable of pivoting movement in the direction of double ended arrow 40 as shown in FIG. 3. By elevating the outer ends of the boom arms 4 by actuation of cylinders 8 the dozer blade 28 will be lifted, but to maintain the surface of the dozer blade in proper angular contact with the ground surface when it is in lowered position, a link member 42 is provided between the cross-member 30 and a cross-member 44 extending between the boom arms. For ease of assembly, this link 42 is secured at its forward end to the cross-member 30 bolt assembly 46, and at its rearward end to the cross-member by means of bolt assembly 48. It will thus be appreciated that raising and lowering of the boom arms 4 will result in a raising and lowering of the dozer blade, but that the link member 42 will always maintain the dozer blade in correct angular relationship to the ground when the blade is in its lowered position.

Figure 2:
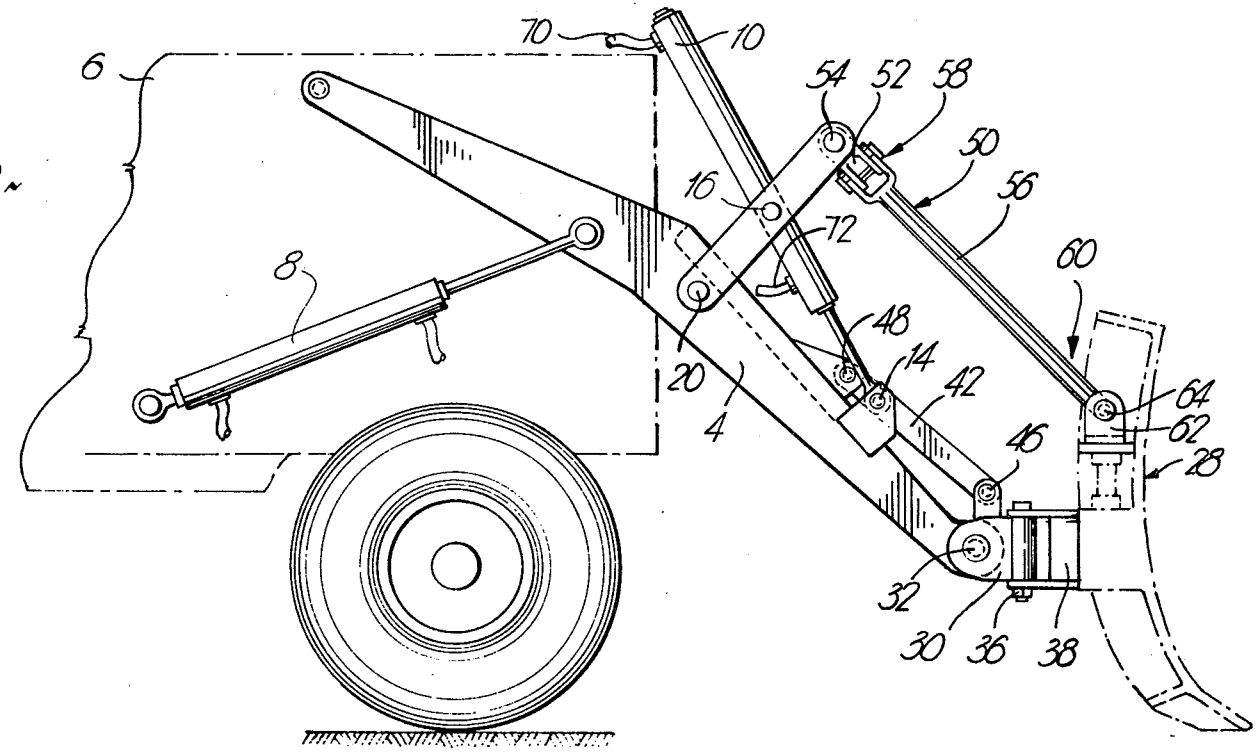
FIG. 2 illustrates the basic machinery as shown in FIG. 1 modified according to the present invention.

Extending between links 18 and the dozer blade 28 are articulated link assemblies generally indicated by numeral 50 in FIGS. 2 and 3. Each link assembly consists of an upper arm 52 which is pivotally secured to the upper arm by pivot assembly 58. The pivoting relationship between the upper 52 and lower arms 56 of the articulated link assembly 50 will be fully understood by reference to accompanying FIG. 4.

Figure 5:
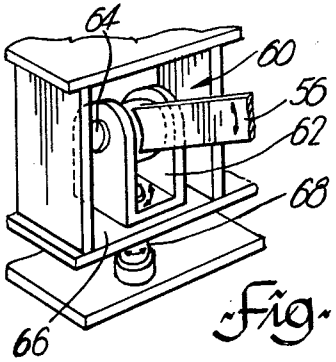
FIG. 5 illustrates in enlarged perspective view a further coupling arrangement as utilized in the assembly according to FIGS. 2 and 3.

The lower end of the lower arm 56 of the articulated link assembly is pivotally secured to the dozer blade by a universal mounting arrangement 60 clearly shown in enlarged view in attached FIG. 5. The lower arm 56 is pivotally secured to a U-shaped bracket 62 by means of pivot pin 64 and the bracket is in turn pivotally mounted on a support 66 by means of a suitable pivot pin 68.

In the prior art embodiment as illustrated in FIG. 1, the hydraulic cylinders 10 are commonly controlled so that both act simultaneously in the same direction to change the angular positioning of the bucket 2 for scooping, lifting or dumping.

Figure 4:
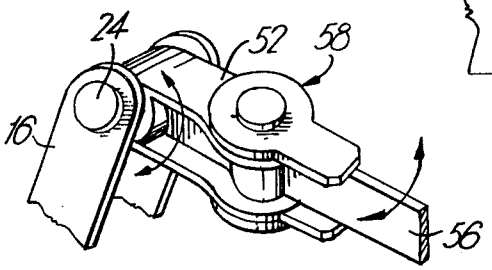
FIG. 4 illustrates in enlarged perspective view a coupling arrangement as shown in FIGS. 2 and 3.

In order that the dozer blade 28 of FIGS. 2 and 3 may be moved either to the left or right in the direction of the double-ended arrow 40 in FIG. 3 it is necessary that the flow through 13 of the hydraulic hoses 70, 72 leading to one of the hydraulic cylinders be reversed, so that when one cylinder 10 is extended, the other cylinder 10 is retracting so that pivoting movement is imparted to the dozer blade. This can be quite simply accomplished by reversing hoses 70 and 72 on one of the cylinders 10 so that when one cylinder is extending, the other is retracting to impart the desired inclination to the blade. This blade inclination is possible because of the articulation points:

1. Central pivoting blade mounting 36;
2. Articulation assembly 58 as shown in FIG. 4;
3. Articulation assembly 60 as shown in FIG. 5.

This mounting arrangement provided on a loader bucket-back hoe machine which in itself is a highly maneuverable piece of apparatus, results in a piece of extremely fine earth and snow moving equipment. The blade construction and design is made as light as possible to ensure all possible traction to the vehicle to the extent that chains on the tires of the vehicle are not usually necessary. The blade is also of an extremely rigid nature being reinforced at critical points to avoid damage should any high impact occur. Known back hoes also have features which is utilized as all hydraulic systems have a "by-pass" which governs the hydraulic pressure according to what the machine is doing. Usual bucket loaders are governed around 2300 psi and if the blade encounters some solid obstacle with either if its corners, and the back hoe has enough forward motion to create pressure in the system over 2300 lbs., the "by-pass" opens allowing the blade to "give" thus avoiding damage.

Most front end bucket loaders utilize two spaced apart and parallel cylinders which are used to load and unload the bucket. The present concept utilizes these existing cylinders to operate the angling of the dozer blade, and this eliminates the use of more cylinders and controls, hoses, and at the same time, takes advantage of existing cylinders, controls, hoses, etc. to enable conversion at minimum cost.

Both cylinders 10 are double-acting and both have two lines leading to each cylinder from a control valve. In known equipment, when the control valve is activated in one direction, both cylinders are extended whereas when the control valve is moved in the other direction, both cylinders are withdranw. Since there usually are only the two lines coming from the control valve to the cylinders the manufacturer finds it necessary to place "tees" in the line in order for the cylinders to function in the same direction at the same time.

To accomplish a reversing of these cylinders when the control valve is actuated, all that is required to do is to switch the hoses at the "tees".

With the present assembly, conversion of a known front end loader assembly to the present plow structure and vice versa is exceedingly simplified and the owner of the piece of equipment then has the opportunity of having a double function arrangement to perform any number of earth or snow moving tasks at the minimum of cost and expense and without having to have two machines.

It is quite a simple matter to convert the scraper blade assembly back to a loader bucket assembly and this changeover can usually be effected in not more than fifteen minutes time.

When replacing the blade with a bucket, the articulated linkage assembly 50 can be used for the presence of the linkages have absolutely no adverse effect on bucket operation.

I claim:

1. Apparatus for converting an earth or snow moving machine having a forwardly mounted bucket pivotable about a horizontal axis to a machine having a scraper or dozer blade pivotally mounted about a vertical axis, and wherein the machine having the forwardly mounted bucket is of the type having a pair of parallel forwardly projecting boom arms having forward ends separately pivotally secured to the bucket for movement of the bucket about a horizontal axis, and a pair of first hydraulic cylinder-pistons to control the positioning of the boom arms and elevation of the bucket, and one of a pair of second hydraulic cylinder-pistons carried by each boom arm to control positioning of the bucket with respect to a horizontal axis, the piston of each second hydraulic cylinder-piston being pivotally secured to its respective boom arm and the cylinder of each second hydraulic cylinder-piston being pivotally secured to an upstanding link arm, the lower end of each link arm being pivotally secured to its respective boom arm and the upper end of each link arm being pivotally secured to one of a pair of link rods which extend forwardly for separate pivotal securement to the bucket, and control valve means for effecting movement of the second cylinder-pistons, the conversion apparatus comprising a first cross-member for extending between and for pivotal securement to the forward ends of the boom arms and which first cross-member has a centrally positioned forwardly extending bracket, and a scraper blade pivotally secured to the said bracket enabling movement of the blade about a vertical axis, and a stabilizing link having a first end secured to the first cross-member and having a second end secured to a second cross-member which extends between and is fixedly secured to the boom axis at a distance rearwardly from the first cross-member, the stabilizing link maintaining the first cross-member in set angular relationship with respect to the boom arms, and a pair of centrally articulated link members having forward ends separately pivotally secured to the scraper blade and rearward ends pivotally secured to the upper ends of their respective link arms, the connections between the second cylinder-pistons and the control valve being reversed enabling angling of the scraper blade about a vertical axis.

* * * * *